US005447225A

United States Patent [19]

Gunn et al.

[11] Patent Number: 5,447,225

[45] Date of Patent: Sep. 5, 1995

[54] PREASSEMBLED TRAY/SHROUD CONTAINER

[75] Inventors: Charles L. Gunn, Lawrenceburg, Ind.; Harold Davis, Cincinnati, Ohio; Tom H. Ohren, Cincinnati, Ohio; David L. Field, Cincinnati, Ohio

[73] Assignee: The Procter & Gamble Company, Cincinnati, Ohio

[21] Appl. No.: 94,280

[22] Filed: Jul. 20, 1993

[51] Int. Cl.[6] ..... B65D 13/00; B65D 5/64

[52] U.S. Cl. ..... 206/44.12; 206/491; 229/125.32; 229/917; 229/920

[58] Field of Search ..... 206/44 R, 44.12, 45.11, 206/577, 491; 229/917, 920, 125.32

[56] References Cited

U.S. PATENT DOCUMENTS

| | | | |
|---|---|---|---|
| 5,195,67 | 3/1993 | Quintana et al. | 229/125.32 X |
| 1,904,760 | 4/1933 | Matheson . | |
| 3,276,666 | 10/1966 | Johnston | 229/51 |
| 3,301,462 | 1/1967 | Starr | 229/917 X |
| 3,360,182 | 12/1967 | Gunn | 229/51 |
| 3,642,192 | 2/1972 | Wilcox, Jr. et al. | 229/917 X |
| 4,784,271 | 11/1988 | Wosaba, II et al. | 206/617 |
| 4,852,796 | 8/1989 | Katzman | 229/125.32 X |
| 4,998,615 | 3/1991 | Bryan | 206/44.12 |
| 5,046,607 | 9/1991 | Focke | 206/44.12 |
| 5,195,677 | 3/1993 | Quintana et al. | 229/125.32 X |

*Primary Examiner*—Jacob K. Ackun

*Attorney, Agent, or Firm*—J. C. Rasser; M. E. Hilton

[57] ABSTRACT

A tray/shroud shipping container which is convertible to a display container upon removal of the shroud. The container is preassembled before being filled with packaged goods from two separate blanks which are joined together to form the container. The container is made from a tray blank for forming the tray and a shroud blank for forming the shroud. The shroud telescopes within the tray and is releasably secured within the tray and covers and protects the packaged goods. The container includes two diagonally opposing vertical fold lines which comprise two substantially parallel lines of weakness. The lines of weakness of each pair are spaced apart by distances least as great as the thickness of the container so that the container can be folded along the lines of weakness thereby collapsing the container to a generally flat condition.

26 Claims, 9 Drawing Sheets

PREASSEMBLED TRAY/SHROUD CONTAINER

FIELD OF THE INVENTION

The present invention relates to containers for shipping and storing products. The present invention has even further relation to such containers that are convertible to display type containers.

BACKGROUND OF THE INVENTION

In the consumer products industry individual products are typically placed in packages and then one or more packages are placed in shipping containers, usually made from corrugated paperboard, for delivery to retail establishments such as supermarkets. When a shelf needs to be stocked with additional product, an employee usually brings a shipping container to the shelf, opens it and places the packages on the shelf. In many instances retail establishments prefer shipping containers which can be converted into display trays. The advantages of display trays include being able to place many products on a shelf in one motion and being able to stack several open trays in an aisle for display purposes. Moreover, retailers prefer that the shipping containers be convertible to display trays without having to use a knife or the like so as to better protect the packages and products within and avoid knife damage.

One such shipping container which is convertible to a display tray is known in the art as a tray/shroud container. An example of a prior art tray/shroud container is shown in FIGS. 1 and 2. FIG. 1 is a perspective view of a tray/shroud shipping container 1 comprising a tray 2 and a shroud 3 which is partially disposed within tray 2. Typically when forming these containers the shroud is formed around a number of individual packages 4, shown in FIG. 2. Thereafter, the tray is constructed and the shroud and the packages are placed within the tray. When the goods are ready to be displayed the shroud is removed as shown in FIG. 2 so that the package goods can be displayed within the tray. The shroud can be adhesively secured within the tray, and preferably includes a means to release the shroud without the use of a knife or the like.

While the above-mentioned container is simple and easy to use, it has many drawbacks. The design is costly in that the shroud must first be formed around the packages, the tray must then be formed and then the shroud and packages placed within the tray. This procedure involves many steps and can be time consuming and expensive. Furthermore, this type of shipping container is not suitable for use with ordinary case packing equipment designed to pack individual packages with an ordinary one-piece, rectangular container or box. That is many consumer products are placed in shipping containers that are not convertible into display trays, but are ordinary one piece rectangular corrugated boxes. Many manufacturing plants have equipment installed that pack these ordinary one piece shipping containers such as one piece regular slotted case erector packers. Such packers are readily available in the market place including for example, a Sure-Way Packaging Machine model R200 or R201 caser having a Salwasser M41 opener, available from Salwasser Manufacturing, Inc. Reedley, Calif. 93654. It would be desirable if the tray/-shroud container could be preassembled, before being packed, so that it looks and functions as an ordinary one piece shipping container. Then the preassembled tray/-shroud container could be packed on the existing case packing equipment installed at the plants, thereby eliminating the need to purchase new equipment which would increase costs. Moreover, for ease of storage, handling and shipping before being packed it is necessary to have the container be collapsible to a generally flat condition.

It is, therefore, an object of the present invention to provide a preassembled tray/shroud container which looks and functions like an ordinary one piece shipping container so that it can be packed with packaged goods on ordinary case packing equipment designed for one-piece containers.

It is another object of the present invention to provide such a container which will lie flat prior to being packed so that it can be stored, handled and shipped easily when empty.

It is yet another object of the present invention to provide such a container that can be opened or converted into a display container without the use of a knife or the like.

The aforementioned and other objects of the invention will become more apparent hereinafter.

SUMMARY OF THE INVENTION

In accordance with the present invention there is provided a collapsible container for shipping and storing packaged goods. The container is made up of a tray for containing the packaged goods and a shroud which fits over the packaged goods and is placed within the tray. The container is preassembled, before being filled with the packaged goods, from two separate blanks which are joined together to form the container. Upon removal of the shroud, the package goods can be displayed within the tray. Furthermore, the container is able to collapse to a generally flat condition for storage when empty.

The container is made up of a tray blank for forming the tray which has top and bottom surfaces. The tray blank comprises a substantially rectangular bottom panel having horizontal and vertical opposing edges. The tray blank includes a pair of horizontal opposing side panels extending from the horizontal edges along horizontal fold lines and a pair of vertical opposing side panels extending from the vertical edges along vertical fold lines. One of the vertical fold lines comprises two parallel lines of weakness. The tray blank further includes a means for connecting the first and second pairs of side panels together in a substantially perpendicular relation to the bottom panel so as to form the tray.

The container further includes a shroud blank for forming the shroud. The shroud blank has top and bottom surfaces and comprises a substantially rectangular top panel having horizontal and vertical opposing edges. The shroud blank has two substantially rectangular opposing end panels extending from the opposing vertical edges of the top panel along vertical fold lines. Each of the end panels has two opposing wing panels extending therefrom along horizontal fold lines. The top surface of the end panels are releasably attached to the top surface of the vertical side panels of the tray blank so that when the container is erected, the shroud telescopes within the tray with the top and bottom panels opposing each other.

Lastly, the vertical fold line on the shroud blank which diagonally opposes the vertical fold line on the tray blank that comprises two substantially parallel lines of weakness also comprises two substantially parallel lines of weakness. The lines of weakness of each pair are spaced apart at a distance at least as great as the thickness of the shroud so that the container can be folded along the two pairs of lines of weakness and collapse to a generally flat condition.

BRIEF DESCRIPTION OF THE DRAWINGS

While the specification concludes with claims particularly pointing out and distinctly claiming the subject invention, it is believed that the same will be better understood from the following description when taken in conjunction with the accompanying drawings in which:

DETAILED DESCRIPTION OF THE INVENTION

Figure 1:
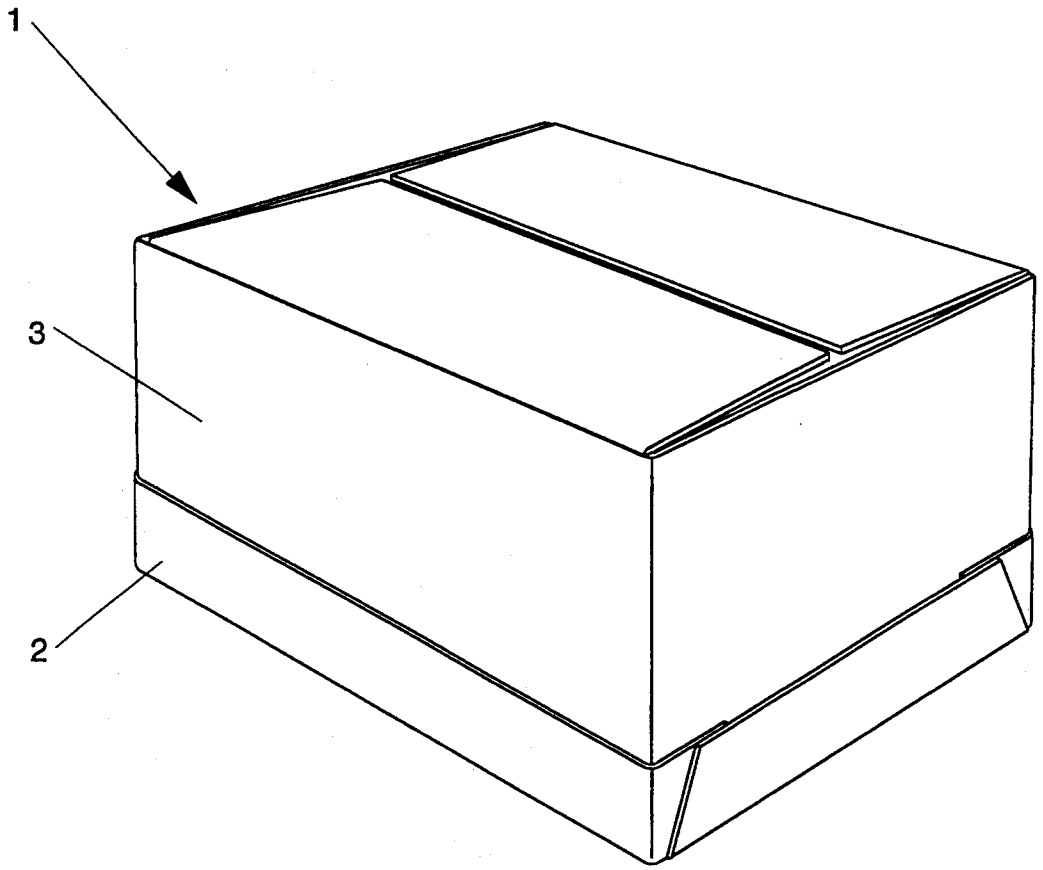
Fig. 1 PRIOR ART
FIG. 1 is a perspective view of a shipping container known in the prior art.
Figure 2:
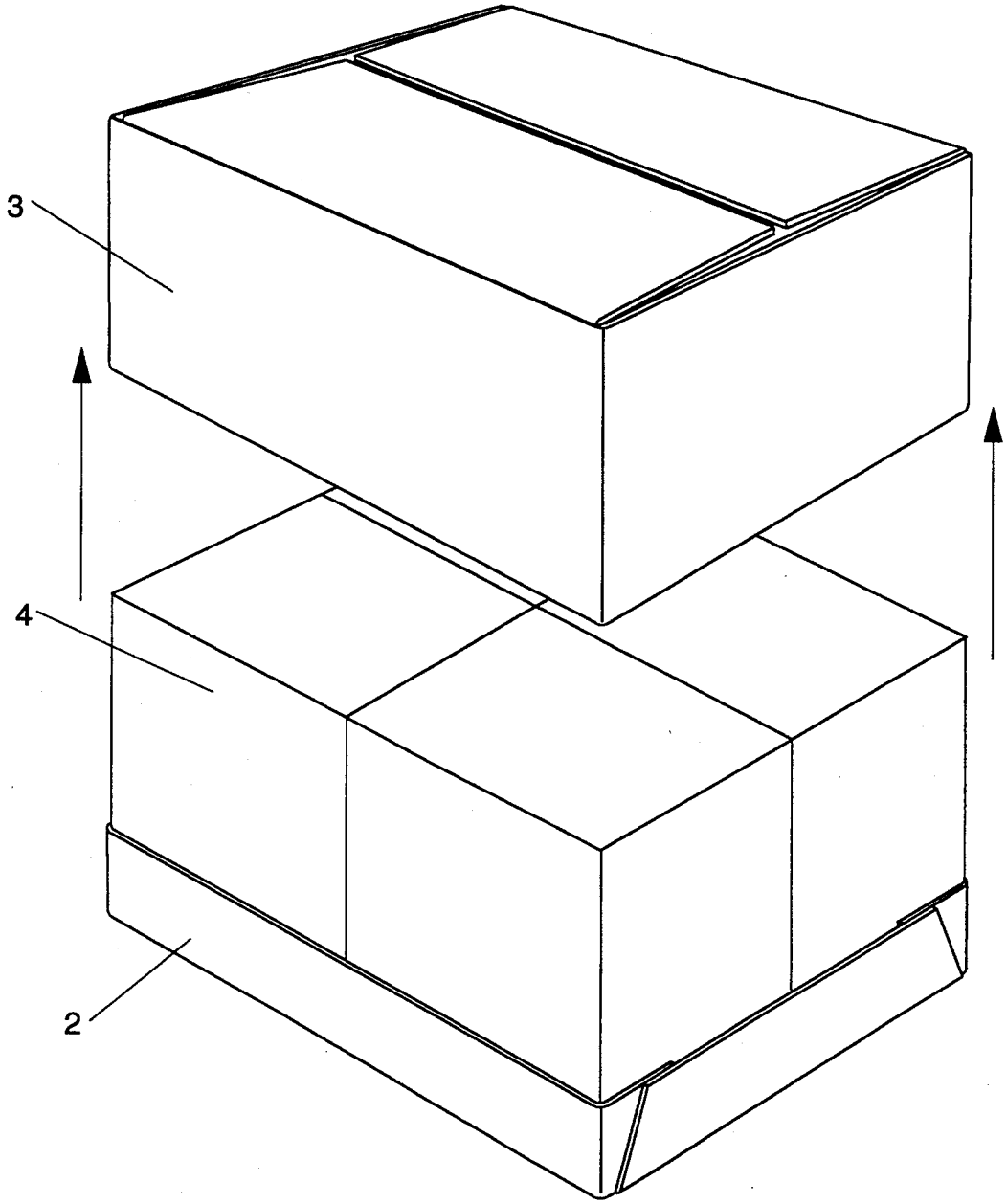
Fig. 2 PRIOR ART
FIG. 2 is a view similar to FIG. 1 with the shroud removed from the tray.
Figure 3:
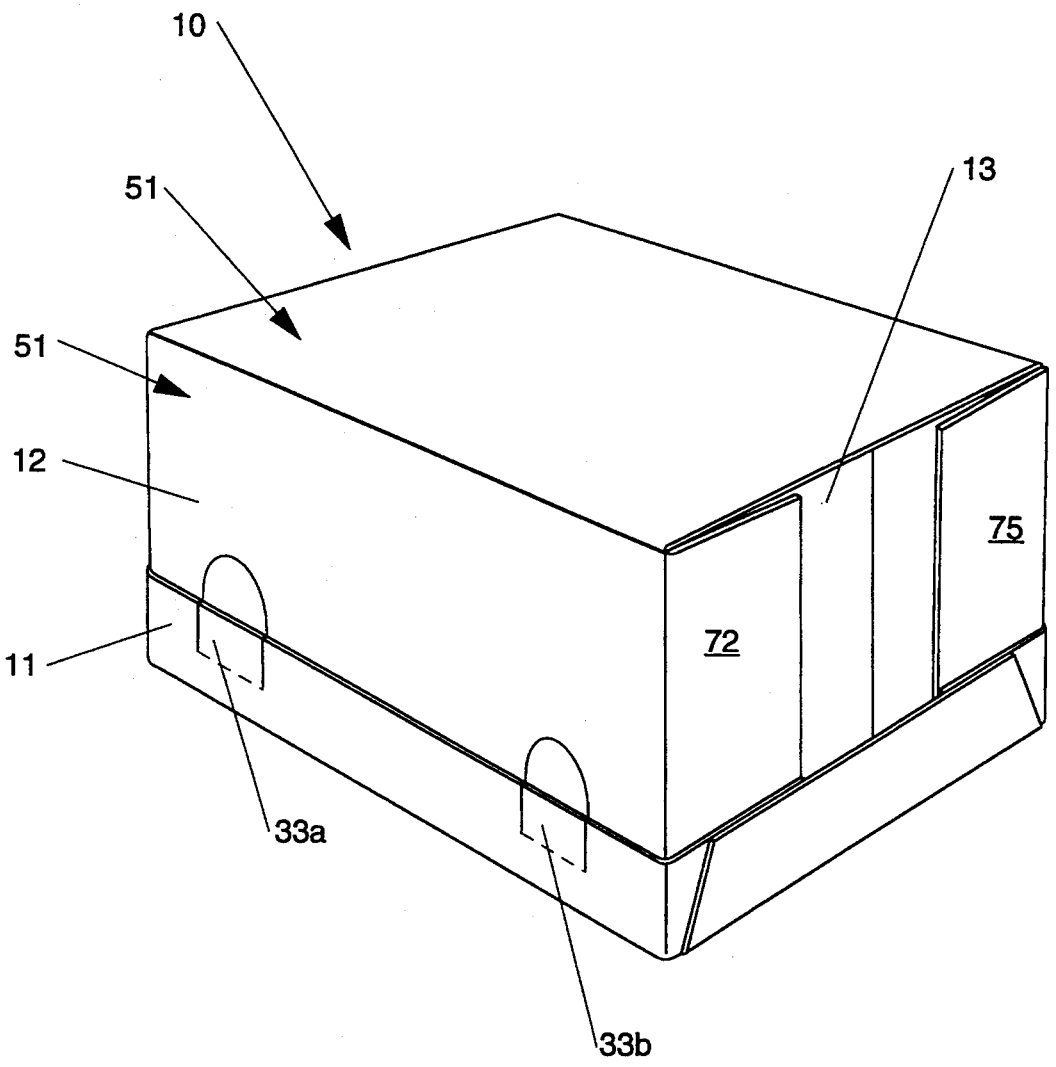
FIG. 3 is a perspective view of the shipping container in accordance with the present invention.

Referring to the drawings in detail where in like numerals indicate the same element throughout the views there shown in FIG. 3 a perspective view of a tray/shroud shipping container 10 in accordance with the present invention. Container 10 comprises tray 11 for containing a number of packaged goods 13. A shroud 12 is disposed over packages 13 and telescopes within and is secured to tray 11. The container is formed from a tray blank and a shroud blank which are preassembled together to form container 10. It is believed that a description of the container and its unique features can best be understood by first describing the structure of each blank.

Figure 7:
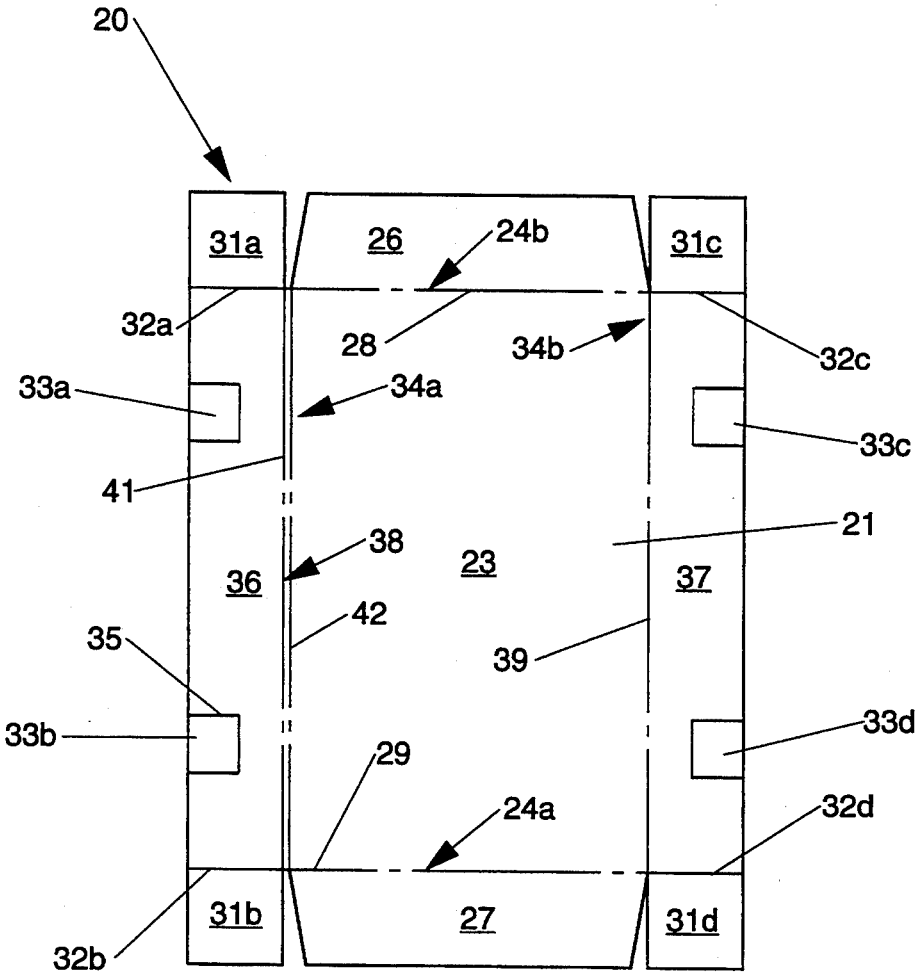
FIG. 7 is a plan view of the tray blank in accordance with the present invention.

Referring to FIG. 7, there is shown a plan view of a tray blank 20 which forms tray 11 in accordance with the present invention. Tray blank 20 has a top surface 21 and a bottom surface 22 (not shown). Tray blank 20 comprises a substantially rectangular bottom panel 23 having horizontal opposing edges 24*a* and 24*b*, and vertical opposing edges 34*a* and 34*b*. Tray blank 20 further includes a pair of horizontal opposing side panels 26 and 27 extending from horizontal edges 24*a* and 24*b* along horizontal fold lines 28 and 29. Tray blank 20 also includes a pair of vertical opposing side panels 36 and 37 extending from vertical edges 34*a* and 34*b* along vertical fold lines 38 and 39. Vertical fold line 38 actually comprises two substantially parallel lines of weakness 41 and 42.

Figure 4:
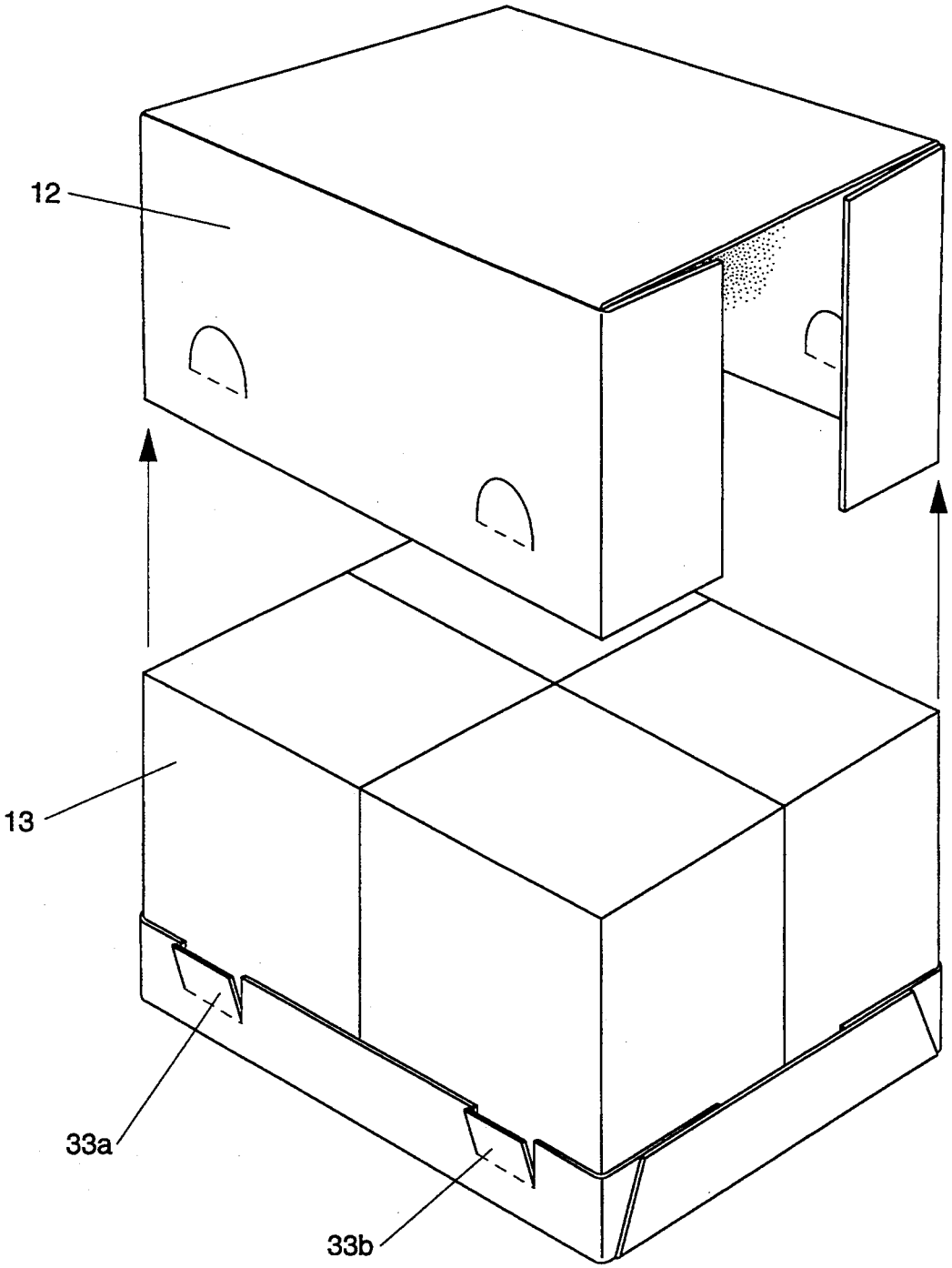
FIG. 4 is a view similar to FIG. 3 with the shroud removed from the tray.

Tray blank 20 must include a means for connecting the horizontal side panels 26 and 27 to the vertical side panels 36 and 37 in substantially perpendicular relation to bottom panel 23 so that tray 11 can be formed as it appears in FIGS. 3 and 4. For the embodiment shown in FIG. 7 this means comprises two pairs of attachment panels 31*a*, 31*b*, and 31*c*, 31*d*, which extend from the vertical side panels 36 and 37 along horizontal fold lines 32*a*, 32*b*, 32*c*, and 32*d*.

Lastly, as will be explained in greater detail later, blank 20 includes four tabs 33*a*, 33*b*, 33*c*, and 33*d*. As seen from tab 33*b*, each tab is formed from two horizontal cuts 35 and 36 extending through the vertical side panels and joined together by a perforated hinge line 41.

Figure 8:
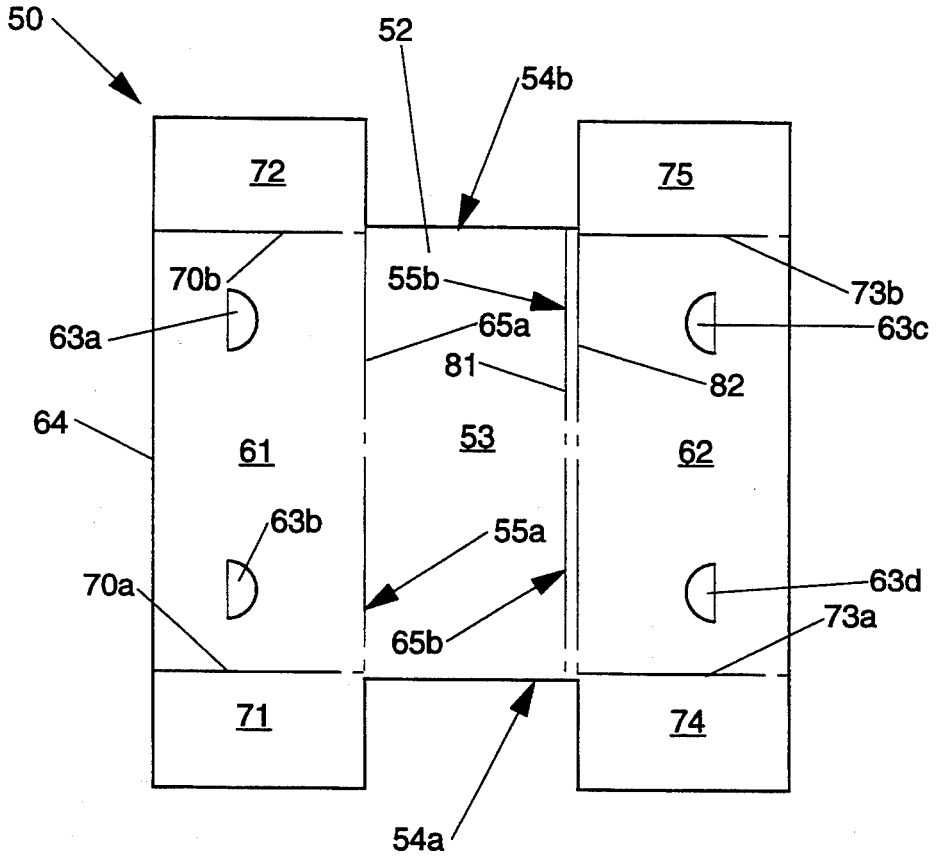
FIG. 8 is a plan view of the shroud blank in accordance with the present invention.

Referring to FIG. 8, there is shown a plan view of the shroud blank 50 which forms shroud 12 in accordance with the present invention. Blank 50 has a top surface 51 (shown in FIG. 3) and a bottom surface 52. Shroud blank 50 comprises a substantially rectangular top panel 53 having horizontal opposing edges 54*a* and 54*b*, and vertical opposing edges 55*a* and 55*b*. The blank has two substantially rectangular opposing end panels 61 and 62 extending from opposing vertical edges 55*a* and 55*b* along vertical fold lines 65*a* and 65*b*. Vertical fold line 65*b*, as seen from FIGS. 5 and 6, will diagonally oppose vertical fold line 38 on tray blank 20 when the container is constructed. In a similar fashion to vertical fold line 38, vertical fold line 65*b* also comprises two substantially parallel lines of weakness 81 and 82. End panel 61 has two opposing wing panels 71 and 72 extending therefrom along horizontal fold lines 70*a* and 70*b*. Similarly, end panel 62 has two opposing wing panels 74 and 75 extending therefrom along horizontal fold lines 73*a* and 73*b*.

As shown in FIG. 8, it is preferred that horizontal fold lines 70*a*, 70*b*, 73*a*, and 73*b* be disposed such that they are positioned more inwardly towards the center of the blank, than are horizontal edges 54*a* and 54*b*. This is when the container is fully constructed and the wing panels are folded, as shown in FIG. 3, wing panels 71, 72, 74 and 75 are positioned well under top panel 53, with a small portion of the top panel extending out over the folded wing panels. This adds to the strength of the container by insuring that when multiple containers are stacked on top of one another, the wing panels help support the weight of the stacked containers and help prevent the packaged goods from being crushed.

Lastly, blank 50 has four cut out sections 63*a*, 63*b*, 63*c*, 63*d* which, as will be explained later, cooperate with the tabs 33*a*–33*d* on the tray blank 20 in order to provide a means for releasing the shroud 12 from tray 11.

Figure 5:
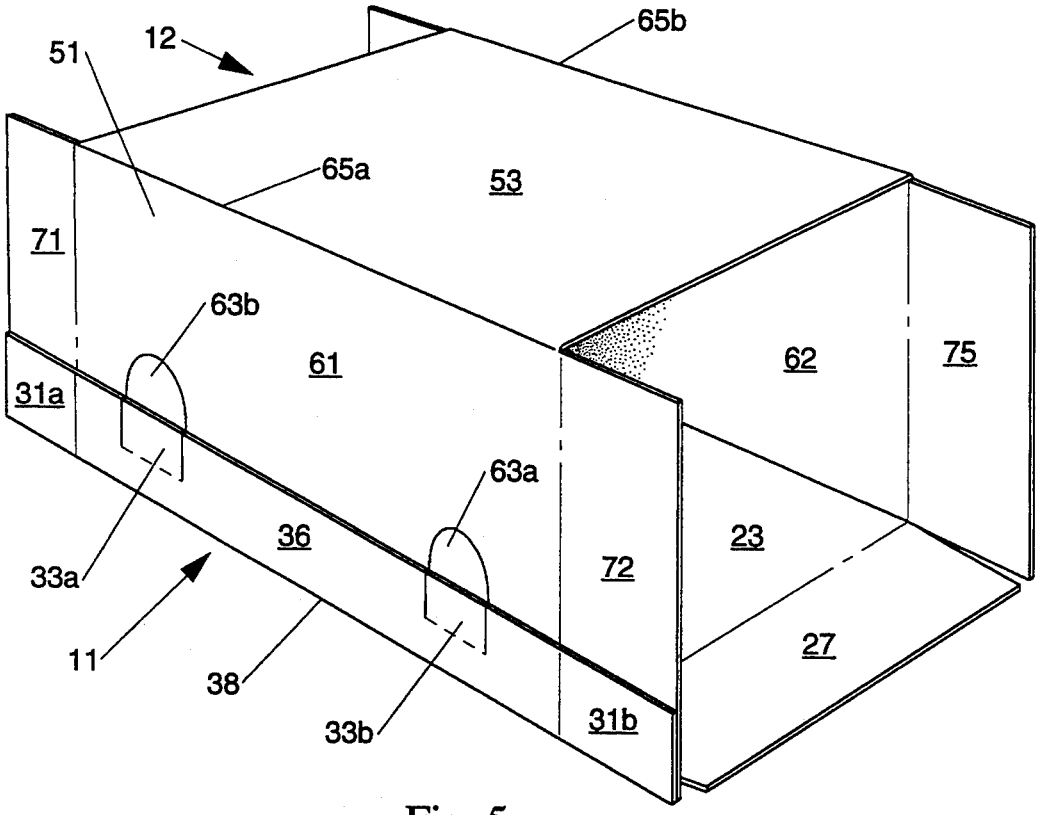
FIG. 5 is a perspective view of the shipping container in accordance with the present invention in its erected but unfilled state.

As seen from FIG. 5, the container is preassembled so that the shroud 12 telescopes within the tray 11, preferably in such a way that edges 64 and 65 (shown in FIG. 8) of end panels 61 and 62 of shroud blank 50 abut against the tray 11. Most preferably, edge 64 abuts against fold line 38 along line of weakness 41 and edge 65 abuts against fold line 39. This is so that when multiple containers are stacked on one another, the shroud supports the weight of the stacked containers and prevents the packaged goods 13 from being crushed.

The top surface 51 of end panels 61 and 62 are secured to the top surface 23 of the vertical side panels 36 and 37 of tray blank 20. For greater strength adhesive could be applied along the entire length of the top surface of end panels 36 and 37. However, to save on costs it is preferred that the tray be secured to the shroud by securing the tabs 33*a*–33*d* of tray 11 to end panels 61 and 62 in an area directly below cut out sections 63*a*–63*d*. Any number of adhesives known in the art can be used to secure the shroud to the tray. When the container is made from corrugated paperboard, a preferred adhesive is a Findley 3031, available from Findley Adhesives, Inc., Wauwatosa, Wis. 53226.

Figure 6:
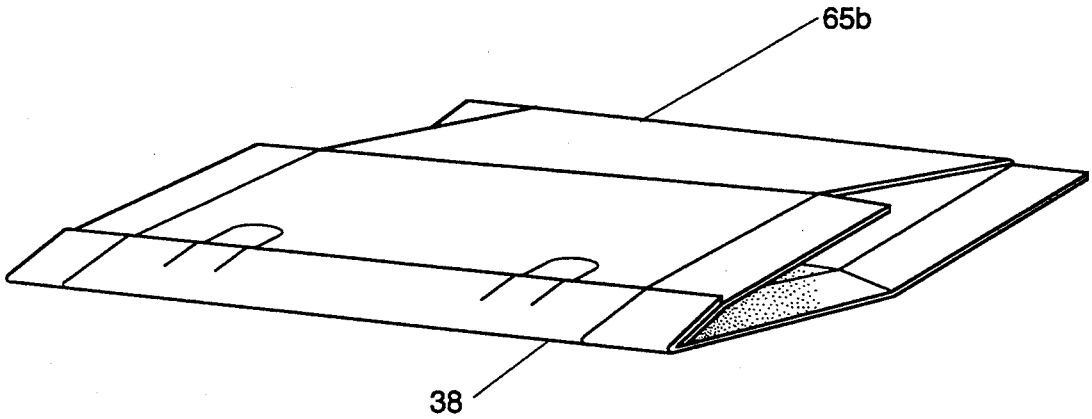
FIG. 6 is a perspective view of the shipping container in accordance with the present invention when the container in its collapsed condition, prior to being packed.

Because vertical fold line 38 of tray blank 20 and its diagonally opposing vertical fold line 65*b* on shroud blank 50 both comprise two substantially parallel lines of weakness 41,42 and 81,82 respectively, the preassembled container shown in FIG. 5 is able to collapse to a generally flat condition as shown in FIG. 6. In order for this to happen though it is necessary that the double score lines 41,42 on the tray be spaced apart at a distance greater than the thickness of the shroud blank from its top surface 51 to its bottom surface 52. In fact, it has been determined, through the use of normal mathematical derivation techniques, that the preferred spacing X between lines 41 and 42 be as follows:

$$X=((2B+A)^2+((A^2-B^2)/(4A-2B))^2)^{\frac{1}{2}}$$

where:

A=shroud thickness

B=tray thickness

When the container is preassembled, as shown in FIG. 5, the outermost edge 64 of end panel 61 abuts directly against line of weakness 41 and side panel 36 is folded along line of weakness 41 when the container is constructed. When the container is collapsed as in FIG. 6 end panel 61 is sandwiched between score lines 41 and 42.

With the container now being collapsed as it appears in FIG. 6 it can behave as an ordinary one piece shipping container. Container 10 will be preassembled and placed in its flat condition for storage, which reduces the amount of space needed to store empty containers. Then when the container is ready to be used it is erected as shown in FIG. 5. Thereafter, a number of packaged goods 13 are placed within the container and the container is constructed. The container is constructed by folding wing panels 71, 72, 74 and 75 so as to be perpendicular to end panels 61 and 62 and positioned beneath top panel 53. The attachment panels 31*a*–31*d* of tray blank 20 are then folded so as to be substantially perpendicular to panels 36 and 37, and are thereafter secured to side panels 26 and 27 by any suitable adhesive. The container now appears as it does in FIG. 3. In order to open the container and display the packaged goods within the tray 11, tabs 33*a*–33*d* on the tray are pulled downwardly, thereby releasing the securement between the shroud 12 and tray 11. Thereafter the shroud 12 can be removed so as to display the packaged goods, as shown in FIG. 4. This design can significantly reduce the amount of time it takes to open the container and unload the goods when compared to prior art tray/-shroud and one piece shipping containers.

The container preferably has a means for viewing the packaged goods 13 before the shroud 12 is removed so that the user can insure he has the desired packaged goods. This can be accomplished by any number of means known in the art including cut outs and the like. As seen from FIG. 3, one means for doing this is to have end flaps 71, 72, 74 and 75 of the shroud be such that when the container is constructed, they do not completely cover the the packaged goods inside. That is, it is preferred that the end flaps be less than half of the width of top panel 53 of shroud blank 50 between opposing vertical edges 55*a* and 55*b*. This results in an opening in the side of the container where one can view the packaged goods so as to ensure they have the packaged goods they desired. However, with heavier packaged goods the relatively small width of the end flaps reduces the amount of weight that can be stacked upon the container before it begins to crush and jeopardize the safety of the packaged goods.

Figure 9:
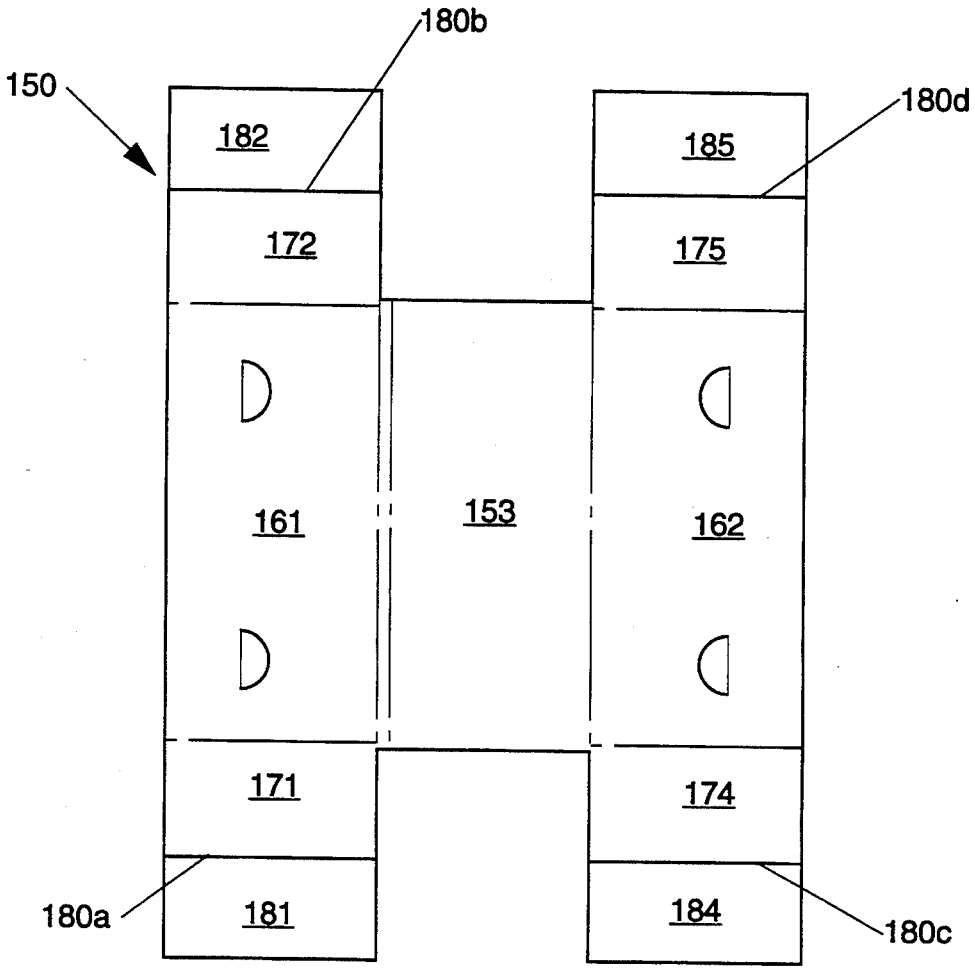
FIG. 9 is a plan view of an alternative embodiment of the shroud blank in accordance with the present invention.

An alternative embodiment of a shroud blank in accordance with the present invention which provides increased strength along the end panels is shown in FIG. 9. FIG. 9, shows a plan view of a shroud blank 150 in accordance with the present invention. Shroud blank 150 is very similar to shroud blank 50 and comprises a substantially rectangular top panel 153 having two substantially rectangular opposing end panels 161 and 162 extending from top panel 153. End panel 161 has two opposing wing panels 171 and 172 extending therefrom and end panel 162 has two opposing wing panels 174 and 175 extending therefrom. The difference between blank 150 and blank 50 is that wing flaps 171, 172, 174 and 175 of blank 150 have support panels 181, 182, 184 and 185 extending therefrom respectively along horizontal fold lines. When the container is constructed these support panels are folded so as substantially juxtapose the wing panels. This effectively makes the wing panels twice as thick as those of blank 50, thereby giving added strength to the container. Moreover, with this the container can be made from thinner packing material and yet still retain good strength.

Figure 10:
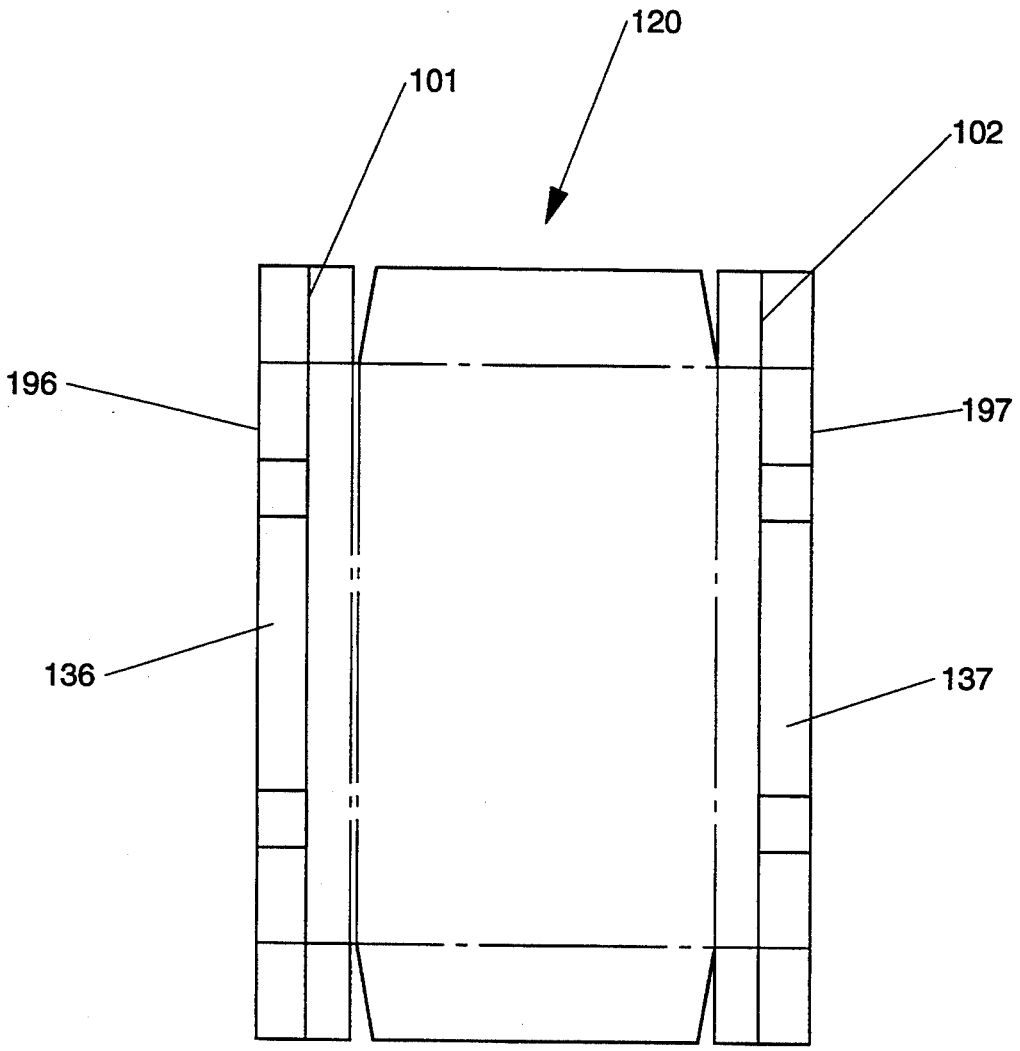
FIG. 10 is a plan view of an alternative embodiment of the tray blank in accordance with the present invention.

When packing the container with rather heavy packaged goods 13, the corners of the tray 11 may need to be reinforced or they might tear. In order to give added strength to the corners reinforcing tape can be employed. This can best be described by referring to FIG. 10 where there is shown an alternative embodiment of a tray blank 120 in accordance with the present invention. Tray blank 120 has the same structure as blank 20 except for the presence of reinforcing strips of tape 101 and 102 running along vertical side panels 136 and 137. In a preferred embodiment the reinforcing tape runs the entire length of panels 136 and 137 and is placed ½ inch from the edges 196 and 197 of end panels 136 and 137. The reinforcing tape can be made from any number of materials known in the art including plastic fiber reinforced tape and the like.

While particular embodiments of the present invention have been illustrated and described various modifications will be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A collapsible container for shipping and storing packaged goods said container comprising a troy for containing said packaged goods and a shroud for fitting over said packaged goods, said shroud being releasably secured within said tray whereby upon removal of said shroud from a tray filled with packaged goods, said packaged goods can be displayed within said tray, said container being collapsible to a generally fiat condition for storage or disposal when empty, said container comprising:

(a) said tray having top and bottom surfaces, said tray comprising a substantially rectangular bottom panel having horizontal and vertical opposing edges, a pair of horizontal opposing side panels extending from said horizontal edges along horizontal fold lines, and a pair of vertical opposing side panels, said vertical side panels having top and bottom surfaces, said vertical side panels extending from said vertical edges along vertical fold lines, one of said vertical fold lines comprising two parallel lines of weakness, said tray including a means for connecting said horizontal and vertical side panels together in a substantially perpendicular relation to said bottom panel; and (b) said shroud having top and bottom surfaces, said shroud comprising a substantially rectangular top panel having horizontal and vertical opposing edges, and two substantially rectangular opposing end panels, said end panels having top and bottom surfaces, said end panels extending from said opposing vertical edges of said top panel along vertical fold lines, each of said end panels having two opposing wing panels extending therefrom along horizontal fold lines, the top surface of said end panels are releasably attached to the top surface of said vertical side panels of said tray so that said shroud telescopes within said tray with said top and bottom panels opposing each other, one of said vertical fold lines on said shroud which diagonally opposes said vertical line on said tray which comprises two substantially parallel lines of weakness also comprises two substantially parallel lines of weakness, said lines of weakness of each pair being spaced apart at a distance great enough to allow said container to be folded along said lines of weakness and collapse to a generally flat condition.

2. The container of claim 1 wherein said shroud telescopes into said tray such that said end panels of said shroud have outermost edges which abut against said vertical fold lines on said tray.

3. The container of claim 2 wherein the outermost edge of the end panel of said shroud that abuts against said vertical fold line of said tray which comprises two substantially parallel lines of weakness, abuts against a line of weakness closest to the vertical side panel extending therefrom.

4. The container of claim 1 wherein said container further includes an integral means for releasing said tray from securement with said shroud.

5. The container of claim 4 wherein said integral means for removing said shroud comprises at least one pull tab on each of said vertical side panels on said tray, said shroud being secured to said tray along said pull tabs such that when said pull tabs are manually rotated, said tray is released from securement with said shroud.

6. The container of claim 5 wherein each of said end panels of said shroud includes one or more cut out sections immediately above said pull tabs so as to give easy access to said pull tabs.

7. The container of claim 1 wherein said means for connecting said horizontal and vertical side panels of said tray together in a substantially perpendicular relation to said bottom panel comprises two pairs of attachment panels, wherein each of said vertical side panels has two attachment panels extending therefrom along opposing horizontal fold lines, said attachment panels are secured to horizontal side panels of said tray.

8. The container of claim 1 wherein each of said fold lines comprises score lines.

9. The container of claim 1 wherein said horizontal fold lines adjacent said wing panels on said shroud are positioned more towards the center of said shroud than are said horizontal edges of said top panel of said shroud, said wing panels are securely positioned below said top panel.

10. The container of claim 1 wherein each of said wing panels of said shroud has at least one support panel extending therefrom along horizontal fold lines which substantially juxtapose said wing panels.

11. The container of claim 1 wherein said vertical opposing side panels of said tray further includes reinforcing tape on said top surface of said tray running substantially parallel to said vertical lines of weakness.

12. The container of claim 11 wherein said reinforcing tape runs along the entire vertical opposing end panels.

13. The container of claim 1 wherein said tray blank and said shroud blank are made from corrugated paperboard.

14. A collapsible container for shipping and storing packaged goods said container comprising a tray for containing said packaged goods and a shroud over said packaged goods, said shroud being releasably secured within said tray whereby upon removal of said shroud from a tray filled with packaged goods, said packaged goods can be displayed within said tray, said container being collapsible to a generally fiat condition for storage or disposal when empty, said container comprising:

(a) said tray having top and bottom surfaces and a thickness (B), said tray comprising a substantially rectangular bottom panel having horizontal and vertical opposing edges, a pair of horizontal opposing side panels extending from said horizontal edges along horizontal fold lines, and a pair of vertical opposing side panels, said vertical side panels having top and bottom surfaces, said vertical side panels extending from said vertical edges along vertical fold lines, one of said vertical fold lines comprising two parallel lines of weakness separated by a distance (X), said tray including a means for connecting said horizontal and vertical side panels together in a substantially perpendicular relation to said bottom panel; and (b) said shroud having top and bottom surfaces and a thickness (A), said shroud comprising a substantially rectangular top panel having horizontal and vertical opposing edges, and two substantially rectangular opposing end panels, said end panels having top and bottom surfaces, said end panels extending from said opposing vertical edges of said top panel along vertical fold lines, each of said end panels having two opposing wing panels extending therefrom along horizontal fold lines, the top surface of said end panels are releasably attached to the top surface of said vertical side panels of said tray so that said shroud telescopes within said tray with said top and bottom panels opposing each other, one of said vertical fold lines on said shroud which diagonally opposes said vertical line on said tray which comprises two substantially parallel lines of weakness also comprises two substantially parallel lines of weakness; and (c) wherein said distance X which separates said two parallel lines of weakness on said tray is equal to $((2B+A)^2+((A2-B2)/(4A-2B))^2)^{\frac{1}{2}}$ so that said container can be folded along said lines of weakness so as to collapse said container to a generally fiat condition.

15. The container of claim 14 wherein said shroud telescopes into said tray such that said end panels of said shroud have outermost edges which abut against said vertical fold lines on said tray.

16. The container of claim 15 wherein the outermost edge of the end panel of said shroud that abuts against said vertical fold line of said tray which comprises two substantially parallel lines of weakness, abuts against a line of weakness closest to the vertical side panel extending therefrom.

17. The container of claim 14 wherein said container further includes an integral means for releasing said tray from securement with said shroud.

18. The container of claim 17 wherein said integral means for removing said shroud comprises at least one pull tab on each of said vertical side panels on said tray, said shroud being secured to said tray along said pull tabs such that when said pull tabs are manually rotated, said tray is released from said securement with said shroud.

19. The container of claim 18 wherein each of said end panels of said shroud includes one or more cut out sections immediately above said pull tabs so as to give easy access to said pull tabs.

20. The container of claim 14 wherein said means for connecting said first and second pairs of side panels of said tray together in a substantially perpendicular relation to said bottom panel comprises two pairs of attachment panels, wherein each of said vertical side panels has two attachment panels extending therefrom along opposing horizontal fold lines, said attachment panels are secured to horizontal side panels of said tray.

21. The container of claim 14 wherein each of said fold lines comprises score lines.

22. The container of claim 14 whereto said horizontal fold lines adjacent said wing panels on said shroud are positioned more towards the center of said shroud than are said horizontal edges of said top panel of said shroud, whereby said wing panels are securely positioned below said top panel.

23. The container of claim 14 wherein each of said wing panels of said shroud has at least one support panel extending therefrom along horizontal fold lines folded so as to substantially juxtapose said wing panels.

24. The container of claim 14 wherein said vertical opposing side panels of said tray further includes reinforcing tape on said top surface of said tray running substantially parallel to said vertical lines of weakness.

25. The container of claim 24 wherein said reinforcing tape runs along the entire vertical opposing end panels.

26. The container of claim 14 whereto said tray and said shroud are made from corrugated paperboard.

* * * * *

UNITED STATES PATENT AND TRADEMARK OFFICE

CERTIFICATE OF CORRECTION

PATENT NO. : 5,447,225

DATED : September 5, 1995

INVENTOR(S) : Charles L. Gunn et al.

It is certified that error appears in the above-identified patent and that said Letters Patent is hereby corrected as shown below:

Column 6, Claim 1, line 60, "troy" should read - - tray - -.

Column 6, Claim 1, line 66, "fiat" should read - - flat - -.

Column 8, Claim 14, line 30, "fiat" should read - - flat - -.

Column 8, Claim 14, line 68, "$((2B+A)^2+((A2-B2)/(4A-2B))^2)^{1/2}$" should read --$((2B+A)^2+((A^2-B^2)/(4A-2B))^2)^{1/2}$--.

Column 9, Claim 14, line 3, "fiat" should read - -flat - -.

Column 10, Claim 22, line 9, "whereto" should read - - wherein - -.

Cloumn 10, Claim 26, line 27, "whereto" should read - - wherein - -.

Signed and Sealed this

Eighteenth Day of January, 2000

*Attest:*

Q. TODD DICKINSON

*Attesting Officer*

*Commissioner of Patents and Trademarks*